US008568055B2

(12) United States Patent
Marques Lito Velez Grilo

(10) Patent No.: US 8,568,055 B2
(45) Date of Patent: Oct. 29, 2013

(54) ADJUSTMENT SYSTEM FOR CONNECTIONS BETWEEN METAL STRUCTURES

(75) Inventor: Vasco Maria Marques Lito Velez Grilo, Paco de Arcos (PT)

(73) Assignee: STEELROOT Portugal, LDA, Lisbon (PT)

( * ) Notice: Subject to any disclaimer, the term of this patent is extended or adjusted under 35 U.S.C. 154(b) by 0 days.

(21) Appl. No.: 13/125,600

(22) PCT Filed: Oct. 23, 2008

(86) PCT No.: PCT/PT2008/000041

§ 371 (c)(1),
(2), (4) Date: May 27, 2011

(87) PCT Pub. No.: WO2010/047608

PCT Pub. Date: Apr. 29, 2010

(65) Prior Publication Data

US 2011/0222957 A1 Sep. 15, 2011

(51) Int. Cl.
*F16C 11/00* (2006.01)
*F16D 3/00* (2006.01)

(52) U.S. Cl.
USPC ..... 403/98; 403/4; 403/116; 248/900; 52/126.1; 52/126.4; 52/126.6

(58) Field of Classification Search
USPC ..... 403/4, 78, 82, 91, 98, 113, 116; 248/188.1–188.4, 900, 909, 548; 52/126.1, 126.3–126.7, 156, 164.1, 52/655.1, 698
See application file for complete search history.

(56) References Cited

U.S. PATENT DOCUMENTS

| | | | | |
|---|---|---|---|---|
| 1,909,260 | A * | 5/1933 | Forbes | 118/323 |
| 2,161,956 | A * | 6/1939 | Robertson | 403/98 |
| 2,575,917 | A * | 11/1951 | Johnson | 403/59 |
| 2,596,007 | A * | 5/1952 | Casaroll | 403/72 |
| 3,918,672 | A * | 11/1975 | Torn et al. | 248/447 |
| 4,035,093 | A * | 7/1977 | Redshaw | 403/4 |
| 5,207,419 | A * | 5/1993 | Schroeder | 473/481 |
| 5,855,443 | A * | 1/1999 | Faller et al. | 403/2 |
| 5,878,540 | A | 3/1999 | Morstein | |
| 6,722,821 | B1 * | 4/2004 | Perko et al. | 405/249 |
| 7,780,128 | B2 * | 8/2010 | Walsberg | 248/188.4 |

FOREIGN PATENT DOCUMENTS

| | | | |
|---|---|---|---|
| DE | 102 26 996 | A1 | 4/2003 |
| WO | 94/26986 | A | 11/1994 |
| WO | 02/099204 | A1 | 12/2002 |
| WO | 2004/090265 | A1 | 10/2004 |
| WO | 2007/110892 | A2 | 10/2007 |

* cited by examiner

*Primary Examiner* — Gregory Binda
*Assistant Examiner* — Nahid Amiri
(74) *Attorney, Agent, or Firm* — Sughrue Mion, PLLC

(57) ABSTRACT

An adjustment system for connections between metal structures which consists of two plates. The adjustment system comprises a first plate (1) provided with four radial slits (4), where one part of the structure to be connected can be joined, and a second plate provided with four circular slits (5) where another part of the structure to be connected can be joined. Joining screw pins (3) pass through the radial slits in plate (1) and through the circular slits in plate (2) in order to join the two parts by means of the corresponding nuts (6) which tighten the said plates together. The adjustment system makes it possible to adjust the position of the two plates (1 and 2) with respect to their movement on axes X, Y and Z.

5 Claims, 4 Drawing Sheets

ADJUSTMENT SYSTEM FOR CONNECTIONS BETWEEN METAL STRUCTURES

CROSS REFERENCE TO RELATED APPLICATION

This application is a National Stage of International Application No. PCT/PT2008/000041 filed Oct. 23, 2008, the contents of all of which are incorporated herein by reference in their entirety.

SCOPE OF THE INVENTION

The present invention relates to a new adjustment system for connections between metal structures which comprises two plates that can be adjusted in relation to each other with respect to their movement on axes X, Y and Z, by altering the relative position of joining pins which work in slits provided in the two said plates.

PRIOR ART

Mechanisms for connecting structures, in particular for foundations, are already known. This is the case of patent application WO 2004/090265.

This international application relates to an adjustment device for a foundation that is intended to be inserted into the ground, the said adjustment device comprising two mounting plates that are located essentially opposite to each other, means for arranging the mounting plates at a certain mutual distance, means for fixing a first mounting plate to the foundation, and that a second mounting plate supports a pole or the like. The adjustment device comprises fixing means formed by a lock bar that is received in the foundation, a first bolt that extends through a first hole of the first mounting plate, and that the lock bar is equipped with means for force transmitting cooperation with the first bolt.

Patent CA 2 287 145 relates to a post holder that is formed by a lower spike portion and an upper bracket portion. The bracket portion is connected to the spike portion at an adjustable connection formed by a curved seat at the upper end of the spike portion and a curved base at the bottom end of the bracket portion.

Patent EP 1 849 920 relates to a tower adapter that includes a cylindrical portion extending in a longitudinal direction of the adapter, and a first lateral portion extending perpendicularly to the cylindrical portion at a first end thereof and having a plurality of first through-holes.

U.S. Pat. No. 5,927,677 relates to a fence post anchor that adjusts for vertical post alignment by providing a post engagement support portion that swivels on a ground securing portion.

As can be seen from the short descriptions given above, the cited prior art relates essentially to the positioning of posts, which is carried out using mechanisms which bear no relation to that of the present patent application. The present application, as well as providing a greater degree of freedom, i.e. more possibilities for adjustment, is mechanically very simple and robust and can be used without any complexity.

BRIEF DESCRIPTION OF THE DRAWINGS

The description hereunder is based on an embodiment represented in the attached drawings in which.

DETAILED DESCRIPTION OF THE INVENTION

Figure 1:
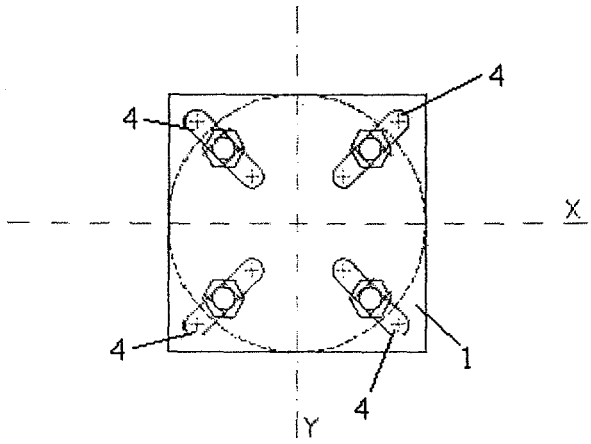
FIG. 1 represents a plan view of one of the plates.
Figure 2:
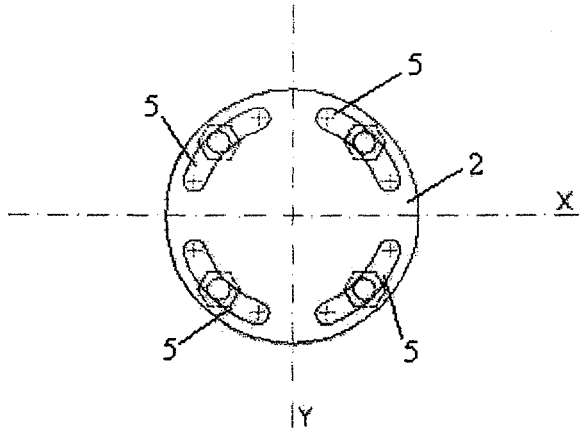
FIG. 2 represents a plan view of the second plate.
Figure 3:
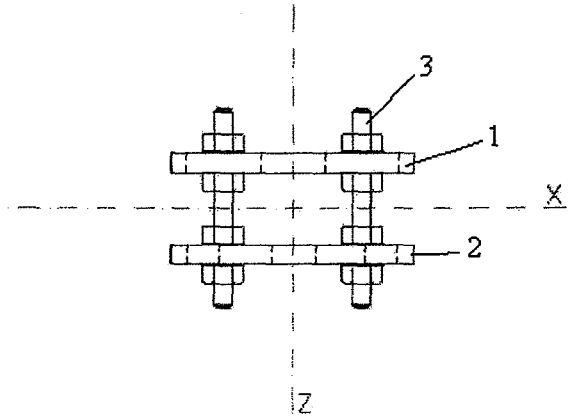
FIG. 3 represents a side elevation view of the adjustment system.
Figure 4:
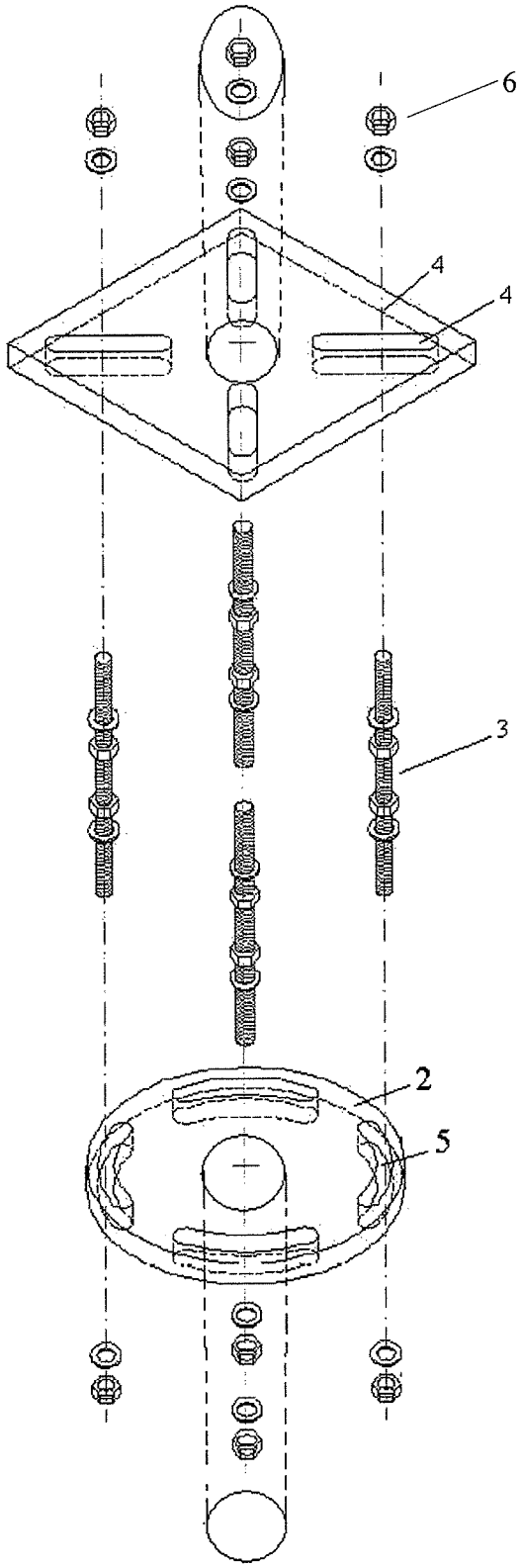
FIG. 4 represents an exploded view of the two plates and of the fixing means of the adjustment system.

As may be observed in the figures, the system of the invention is essentially comprised of two plates (1) and (2) joined by screw pins (3). The upper metal structure is connected to plate (1), while the lower structure is connected to plate (2). The upper plate (1) is provided with four radial slits (4), while the lower plate (2) has four circular slits (5). The said screw pins (3) pass through the radial slits in plate (1) and through the circular slits in plate (2) in order to join the two parts by means of two pairs of nuts/rings (6) which tighten the said plates (1 and 2) together.

The position of the two plates can be adjusted with respect to movement and rotation in various ways, namely in relation to their movement on axes X, Y and Z.

More specifically, the position between the two plates can be adjusted:

1—with respect to their rotation on axes X and Y, by altering the relative position of the pins (3) in the slits (4 and 5) of the two plates (1 and 2).

2—with respect to their rotation on axis Z, by altering the position of the pins in the circular slits (5) of plate (2).

3—with respect to their movement on axis Z, by altering the length of the pins used and the space left between the nuts on each pin.

4—with respect to their rotation on axes X and Y, by altering the length of the pins used and the space left between the nuts on each pin.

Figure 5:
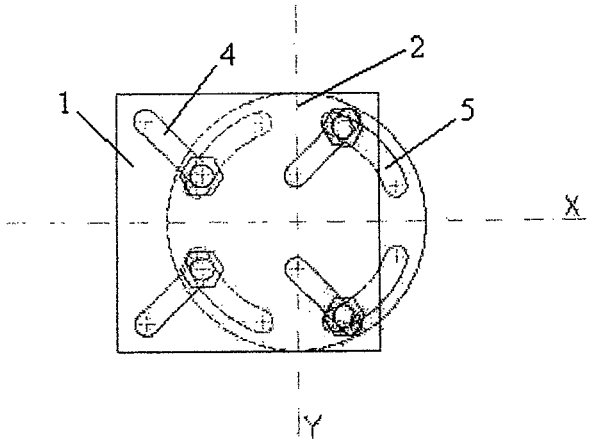
FIGS. 5 to 8 represent plan views and a side elevation (FIG. 8) of situations of use in limit cases.
Figure 6:
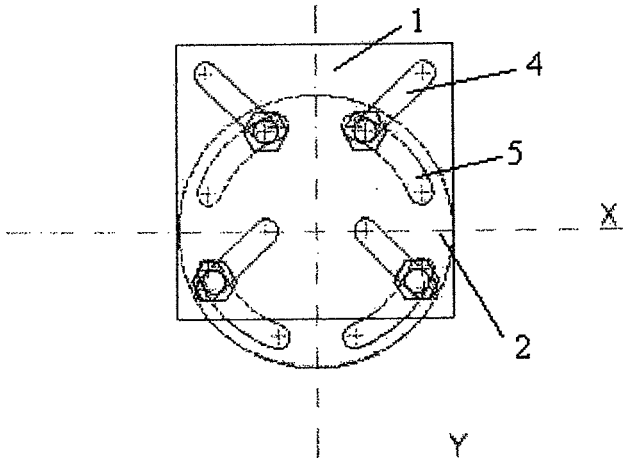
Figure 7:
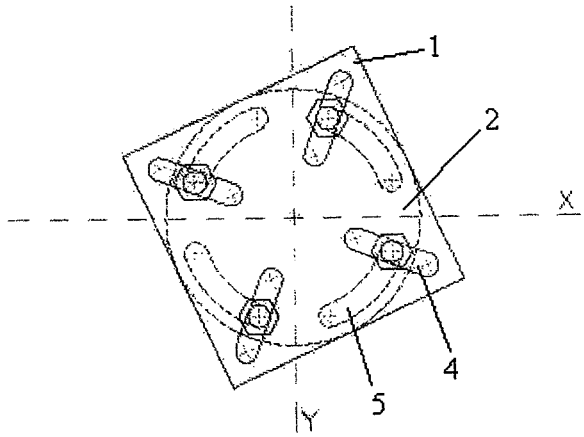
Figure 8:
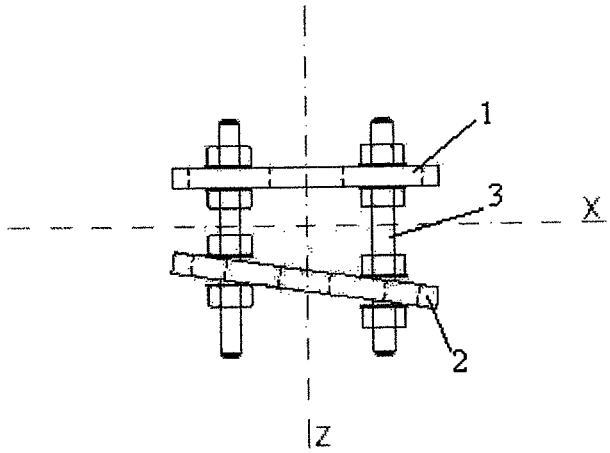

These situations are represented in FIGS. 5 to 8 of the attached drawings. Specifically, FIG. 5 shows a case of the joining of plates with maximum translation on axis X, while FIG. 6 shows the maximum translation on axis Y. FIG. 7 shows a case of the joining of plates (1) and (2) with maximum rotation on axis Z. Finally, FIG. 8 shows the joining of plates using translation on axis Z and rotation on axes X and Y.

As may be understood from the above description, the system of the invention will make it possible to connect metal structures extremely easily without the need to strictly align the plates to which they are joined. In fact, the system permits various adjustment possibilities but without reducing the safety of the connection.

This system of joining plates can be used in various situations, basically in situations which require the joining of two metal structures, which in turn are connected to joining plates. For example, it can be applied to foundations, more specifically foundations for solar panel farms and wind microgeneration towers.

The invention claimed is:

1. An adjustment system for connections between two metal structures that are to be connected, comprising:

a first plate (1) provided with four radial slits (4) where a part of one metal structure to be connected can be joined;

a second plate provided with four circular slits (5) where another part of another metal structure to be connected can be joined;

joining screw pins (3) which pass through the radial slits in the first plate (1) and through the circular slits in the second plate (2) in order to join the two metal structures by means of the corresponding nuts (6) which tighten the first and second plates together, wherein a position of the first and second plates (1 and 2) is adjustable with respect to their movement on three orthogonal axes X, Y and Z, and whereby there is provided six degrees of freedom of the connection system plus rotation around the axes.

2. The adjustment system for connections between two metal structures according to claim 1, wherein the position between the two plates is adjustable with respect to their rotation on axes X and Y by altering a relative position between the pins (3) and the slits (4 and 5) of the two plates (1 and 2).

3. The adjustment system for connections between two metal structures according to claim 1, wherein the position between the two plates is adjustable with respect to their rotation on axis Z, by altering a position of the pins in the circular slits (5) of plate (2).

4. The adjustment system for connections between two metal structures according to claim 1, wherein the position between the two plates is adjustable with respect to their movement on axis Z, by altering a length of the pins used and a space left between the nuts on each pin.

5. The adjustment system for connections between two metal structures according to claim 1, wherein the position between the two plates is adjustable with respect to their rotation on axes X and Y, by altering a length of the pins used and a space left between the nuts on each pin.

* * * * *